US006680584B2

(12) United States Patent
Ohsawa

(10) Patent No.: US 6,680,584 B2
(45) Date of Patent: Jan. 20, 2004

(54) DEVICE FOR DRIVING DISCHARGE LAMP

(75) Inventor: Takashi Ohsawa, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/275,105

(22) PCT Filed: Mar. 1, 2001

(86) PCT No.: PCT/JP01/01588

§ 371 (c)(1),
(2), (4) Date: Nov. 1, 2002

(87) PCT Pub. No.: WO02/071814

PCT Pub. Date: Sep. 12, 2002

(65) Prior Publication Data

US 2003/0107329 A1 Jun. 12, 2003

(51) Int. Cl.[7] ..... H05B 37/02
(52) U.S. Cl. ..... 315/224; 315/291; 315/307
(58) Field of Search ..... 315/219, 220, 315/224, 225, 244, 291, 307, DIG. 7

(56) References Cited

U.S. PATENT DOCUMENTS 4,980,811 A * 12/1990 Suzuji et al. ..... 363/21.07
5,384,518 A * 1/1995 Kido et al. ..... 315/225

FOREIGN PATENT DOCUMENTS

JP 2000-12273 * 1/2000 ..... H05B/41/282

* cited by examiner

*Primary Examiner*—Don Wong
*Assistant Examiner*—Thuy Vinh Tran
(74) *Attorney, Agent, or Firm*—Sughrue Mion, PLLC

(57) ABSTRACT

A referential rectangular wave is generated in a referential rectangular wave generating circuit 21, a level of the referential rectangular wave is integrated in an integrating circuit 22 to produce a chopping wave. In a comparing circuit 23, a voltage level of the chopping wave produced in the integrating circuit 22 is compared with a level of a feed-back voltage, and a control signal is output to a transistor 9. Also, in a delaying circuit 24, the control signal produced in the comparing circuit 23 is delayed by a delaying time corresponding to 180 degrees in a phase of the control signal without changing a duty ratio in an on-off control of a transistor 10, and the control signal is output to the transistor 10.

8 Claims, 10 Drawing Sheets

DEVICE FOR DRIVING DISCHARGE LAMP

TECHNICAL FIELD

The present invention relates to an electric-discharge lamp lighting apparatus in which voltage applied to an electric-discharge lamp is generated by using a transformer.

BACKGROUND ART

FIG. 1 is a circuit view showing a conventional electric-discharge lamp lighting apparatus disclosed in the Published Unexamined Japanese Patent Application No. 2000-12273. In FIG. 1, 1 indicates a direct-current power source (12 V). 2 indicates an LC filter. 3*a* indicates a primary winding connected with the direct-current power source 1. 4*a* indicates a primary winding connected with the direct-current power source 1. 3*b* indicates a secondary winding for rising a level of voltage generated in the primary winding 3*a*. 4*b* indicates a secondary winding for rising a level of voltage generated in the primary winding 4*a*. 3 indicates a transformer. 4 indicates a transformer.

5 indicates a smoothing circuit for smoothing a level of voltage generated in the secondary winding 3*b* and a level of voltage generated in the secondary winding 4*b*. 6 indicates an H-bridge circuit for inverting a polarity of a current supplied to an electric-discharge lamp 8. 7 indicates a high-voltage generating circuit for generating a high voltage (about 20 kV) required to light the electric-discharge lamp 8. 8 indicates the electric-discharge lamp (HID) boarded on a vehicle. For example, a halogen lamp generally used as an electric-discharge lamp has a luminance ranging from 1000 to 1500 lm. In contrast, the electric-discharge lamp 8 has a luminance of 3200 lm, so that the electric-discharge lamp 8 is a very bright lamp.

9 indicates a transistor for performing an on-off control to apply a voltage or no voltage to the primary winding 3*a*. 10 indicates a transistor for performing an on-off control to apply a voltage or no voltage to the primary winding 4*a*. 11 indicates an inverter for inverting a chopping wave. 12 indicates a feed-back circuit for generating a feed-back voltage. 13 indicates a comparing circuit for comparing a voltage level of the chopping wave and a level of the feed-back voltage generated by the feed-back circuit 12 and outputting a control signal to the transistor 9. 14 indicates a comparing circuit for comparing a voltage level of the chopping wave inverted by the inverter 11 and a level of the feed-back voltage generated by the feed-back circuit 12 and outputting a control signal to the transistor 9.

Next, an operation will be described below.

A power source voltage of the direct-current power source 1 is applied to the primary windings 3*a* and 4*a* of the transformers 3 and 4. When an on-off control (or a chopping control) for the power source voltage is performed by the transistors 9 and 10, a risen-up voltage higher than the power source voltage is generated in the secondary windings 3*b* and 4*b* of the transformers 3 and 4. A current of the risen-up voltage higher than the power source voltage generated in the secondary windings 3*b* and 4*b* of the transformers 3 and 4 is smoothed in the smoothing circuit 5, and the risen-up voltage is applied to the electric-discharge lamp 8 while inverting the polarity of the current of the risen-up voltage in the H-bridge circuit 6. Also, because a high voltage of about 20 kV is required to light the electric-discharge lamp 8, the risen-up voltage is applied to the electric-discharge lamp 8 through the high-voltage generating circuit 7.

Here, control signals for the transistors 9 and 10 are produced as follows.

A chopping wave used as a reference wave is inverted in the inverter 11 and is supplied to the comparing circuit 14. In the comparing circuit 13, a voltage level of the chopping wave not inverted is compared with a level of the feed-back voltage generated by the feed-back circuit 12, and a control signal is output to the transistor 9. Also, in the comparing circuit 14, a voltage level of the chopping wave inverted in the inverter 11 is compared with a level of the feed-back voltage generated by the feed-back circuit 12, and a control signal is output to the transistor 10.

Therefore, the control signals have phases shifted from each other by 180 degrees and are supplied to the transistors 9 and 10.

Because the conventional electric-discharge lamp lighting apparatus has the above-described configuration, the chopping wave used as a reference wave is inverted in the inverter 11 to generate the control signals having phases shifted from each other by 180 degrees and to supply the control signals to the transistors 9 and 10. However, the chopping wave cannot be preferably inverted in the inverter 11.

Also, there is another configuration in which an operation amplifier (or an inverting amplifier) is used in place of the inverter 11 to invert the chopping wave used as a reference wave in the operation amplifier. However, to obtain an inverted chopping wave symmetric to the chopping wave used as a reference wave, it is required to perform an inversion operation within a time-period in which the operation amplifier can follow to the chopping wave. Therefore, when a chopping wave having a high frequency is input to the operation amplifier, the operation amplifier cannot follow a leading edge or a trailing edge of the chopping wave, the amplified chopping wave having a level gradually changed is output from the operation amplifier, a wave height value of the inverted chopping wave is lowered, and the symmetry between the inverted chopping wave and the chopping wave used as a reference wave is undesirably lost.

In general, in a widely-used operation amplifier manufactured at low cost, to obtain an inverted chopping wave symmetric to the chopping wave used as a reference wave, the maximum of a frequency of the chopping wave is limited to tens kHz. In contrast, to operate the conventional electric-discharge lamp lighting apparatus shown in FIG. 1, it is required to operate the conventional electric-discharge lamp lighting apparatus at a high speed corresponding to a frequency higher than tens kHz. Therefore, to follow to each input pulse of a chopping wave having a high frequency, it is undesirably required to use an expensive operation amplifier operative at high frequency.

Also, in case of the operation of an electric-discharge lamp lighting apparatus having the transformers 3 and 4 and the transistors 9 and 10 shown in FIG. 1, when a duty ratio of the control signal used for the on-off control of the transistor 9 considerably differs from a duty ratio of the control signal used for the on-off control of the transistor 10, an electric power and loss loaded on the transformer 3 is unbalance with that on the transformer 4. Therefore, it is undesirably required to use the transformers 3 and 4 and the transistors 9 and 10 respectively having a surplus size for the operation of the electric-discharge lamp lighting apparatus, and a problem has arisen that an electric-discharge lamp lighting apparatus having a small size cannot be manufactured at low cost.

As another technical literature relating to the prior art, the Published Unexamined Japanese Patent Application No. H10-25775 (1998) is known.

The present invention is provided to solve the above-described problem, and the object of the present invention is to provide an electric-discharge lamp lighting apparatus which is manufactured at low cost and is operated at high speed operation without using a circuit for inverting a chopping wave used as a reference wave.

DISCLOSURE OF THE INVENTION

An electric-discharge lamp lighting apparatus according to the present invention written in claim 1 of "WHAT IS CLAIMED IS" includes a referential rectangular wave generating circuit for generating a referential rectangular wave, an inverting circuit for inverting the referential rectangular wave generated in the referential rectangular wave generating circuit, a first integrating circuit and a second integrating circuit for integrating a level of the referential rectangular wave generated in the referential rectangular wave generating circuit and a level of a rectangular wave inverted in the inverting circuit respectively and producing chopping waves respectively, and a first comparing circuit and a second comparing circuit for comparing levels of the chopping waves produced in the first integrating circuit and the second integrating circuit with a feed-back voltage sent from a feed-back circuit respectively and outputting control signals to a first switching circuit and a second switching circuit respectively.

Therefore, because the chopping waves inverted to each other are produced in the first integrating circuit and the second integrating circuit after the referential rectangular wave is inverted in the inverting circuit, an electric-discharge lamp lighting apparatus operable at high speed can be obtained at low cost without using a circuit for inverting any chopping wave.

An electric-discharge lamp lighting apparatus according to the present invention written in claim 2 of "WHAT IS CLAIMED IS" includes a referential rectangular wave generating circuit for generating a referential rectangular wave, a flip flop circuit for diving a frequency of the referential rectangular wave by two and producing a non-inverted rectangular wave and an inverted rectangular wave, a first integrating circuit and a second integrating circuit for integrating levels of the inverted rectangular wave and the non-inverted rectangular wave produced in the flip flop circuit respectively and producing chopping waves respectively, and a first comparing circuit and a second comparing circuit for comparing levels of the chopping waves produced in the first integrating circuit and the second integrating circuit with a feed-back voltage sent from a feed-back circuit respectively and outputting control signals to a first switching circuit and a second switching circuit respectively.

Therefore, because a non-inverted chopping wave and an inverted chopping wave are produced in the first integrating circuit and the second integrating circuit after the non-inverted rectangular wave and the inverted rectangular wave are produced in the flip flop circuit, an electric-discharge lamp lighting apparatus operable at high speed can be obtained at low cost without using a circuit for inverting any chopping wave. Also, because a frequency of the referential rectangular wave is divided by two in the flip flop circuit, a duty ratio of the rectangular wave produced in the flip flop circuit is set to 50%. Therefore, no DC offset occurs in the produced chopping waves, and the control signals set with high accuracy can be output.

An electric-discharge lamp lighting apparatus according to the present invention written in claim 3 of "WHAT IS CLAIMED IS" includes a comparing power source for generating a comparing voltage, a third comparing circuit and a fourth comparing circuit for comparing the comparing voltage with a first chopping wave and a second chopping wave respectively, an RS flip flop circuit for receiving output signals of the third comparing circuit and the fourth comparing circuit and producing a non-inverted rectangular wave and an inverted rectangular wave, a first integrating circuit and a second integrating circuit for integrating levels of the inverted rectangular wave and the non-inverted rectangular wave produced in the RS flip flop circuit respectively to produce the first chopping wave and the second chopping wave and supplying the first chopping wave and the second chopping wave to the third comparing circuit and the fourth comparing circuit respectively, and a first comparing circuit and a second comparing circuit for comparing levels of the chopping waves produced in the first integrating circuit and the second integrating circuit respectively with a feed-back voltage sent from a feed-back circuit and outputting control signals to a first switching circuit and a second switching circuit respectively.

Therefore, because a non-inverted chopping wave and an inverted chopping wave are produced in the first integrating circuit and the second integrating circuit after the non-inverted rectangular wave and the inverted rectangular wave are produced in the RS flip flop circuit, an electric-discharge lamp lighting apparatus operable at high speed can be obtained at low cost without using a circuit for inverting any chopping wave. Also, a result of a comparison between the first produced chopping wave and the comparing voltage is obtained, a result of a comparison between the second produced chopping wave and the comparing voltage is obtained, and a self-oscillating type is adopted by feeding back the comparison results to the RS flip flop circuit. Therefore, a DC offset between the chopping waves does not occur due to each constituent element of the first and second integrating circuits not correctly set to a designed function. Accordingly, the chopping waves symmetric to each other with respect to the wave height value can be obtained, and the control signals set with high accuracy can be output.

In an electric-discharge lamp lighting apparatus according to the present invention written in claim 4 of "WHAT IS CLAIMED IS", the first integrating circuit includes a first resisting element and a common condenser, the second integrating circuit includes a second resisting element and the common condenser, and the common condenser is connected with both an output terminal of the first resisting element and an output terminal of the second resisting element in parallel connection.

Therefore, because the condenser is used for the first integrating circuit and the second integrating circuit in common, as compared with a case where a condenser is arranged in each of the first integrating circuit and the second integrating circuit, the total configuration of the first integrating circuit and the second integrating circuit can be simplified, and the asymmetry between the chopping waves due to each condenser not correctly set to a designed function can be suppressed.

In an electric-discharge lamp lighting apparatus according to the present invention written in claim 5 of "WHAT IS CLAIMED IS", the first integrating circuit includes a first condenser in which one end is connected with the output terminal of the first resisting element and the other end is grounded, and the second integrating circuit further comprises a second condenser in which one end is connected with the output terminal of the second resisting element and the other end is grounded.

Therefore, the condensers 34*a* and 35*a* are arranged in the integrating circuits 22 and 26 respectively to reduce the distortion of the chopping waves, and the distortion of the chopping waves occurring due to a phase difference between the non-inverted rectangular wave and the inverted rectangular wave produced in the RS flip flop circuit can be reduced by the function of the first and second condensers. Here, capacities of the first and second condensers can be set to ½ of a capacity of the common condenser, and adverse influence caused by the first and second condensers not accurately set to designed functions can be reduced.

An electric-discharge lamp lighting apparatus according to the present invention written in claim 6 of "WHAT IS CLAIMED IS" includes a switching circuit, connected with the third comparing circuit and the RS flip flop circuit, for performing an on-off control according to an output signal of the fourth comparing circuit.

Therefore, even though the output signals of the third and fourth comparing circuits are set to the L level together at an operation start time, the third switching circuit performs an off control to set one input signal of the RS flip flop circuit to the H level. Therefore, the normal operation of the RS flip flop circuit can be performed.

In an electric-discharge lamp lighting apparatus according to the present invention written in claim 7 of "WHAT IS CLAIMED IS", the comparing power source is formed of a variable power source, and the comparing voltage generated in the variable power source is arbitrarily adjustable.

Therefore, the output signals of the third and fourth comparing circuits can be adjusted according to the adjustment of the comparing voltage, and the cycle of each chopping wave generated can be arbitrarily adjusted.

In an electric-discharge lamp lighting apparatus according to the present invention written in claim 8 of "WHAT IS CLAIMED IS", the RS flip flop circuit is formed of a logic gate integrated circuit.

Therefore, the RS flip flop circuit can be easily formed of the logic gate integrated circuit.

BEST MODE FOR CARRYING OUT THE INVENTION

Hereinafter, the best mode for carrying out the present invention will now be described with reference to the accompanying drawings to explain the present invention in more detail.

Embodiment 1

Figure 1:
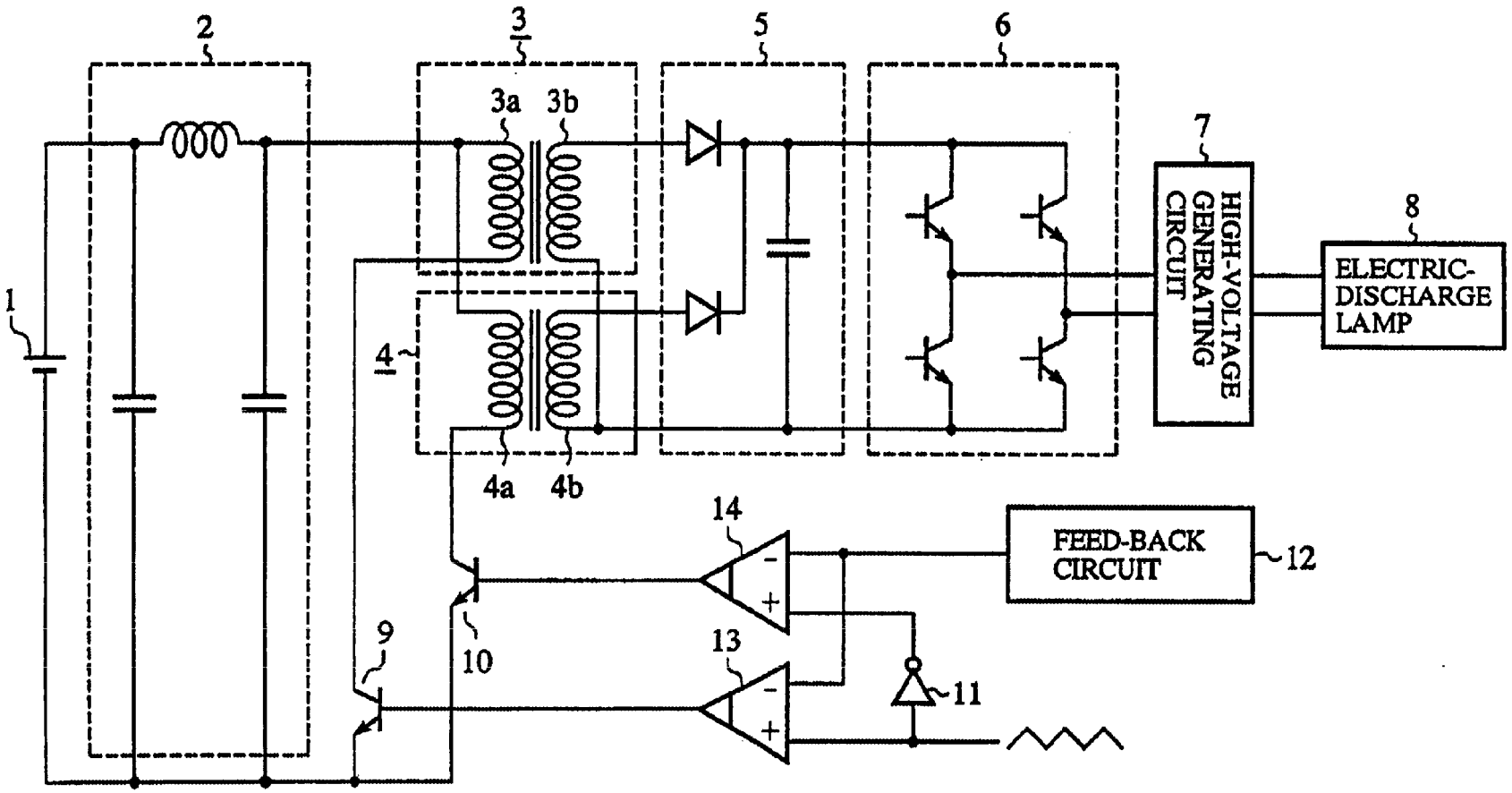
PRIOR ART FIG.1
FIG. 1 is a circuit view showing a conventional electric-discharge lamp lighting apparatus.
Figure 2:
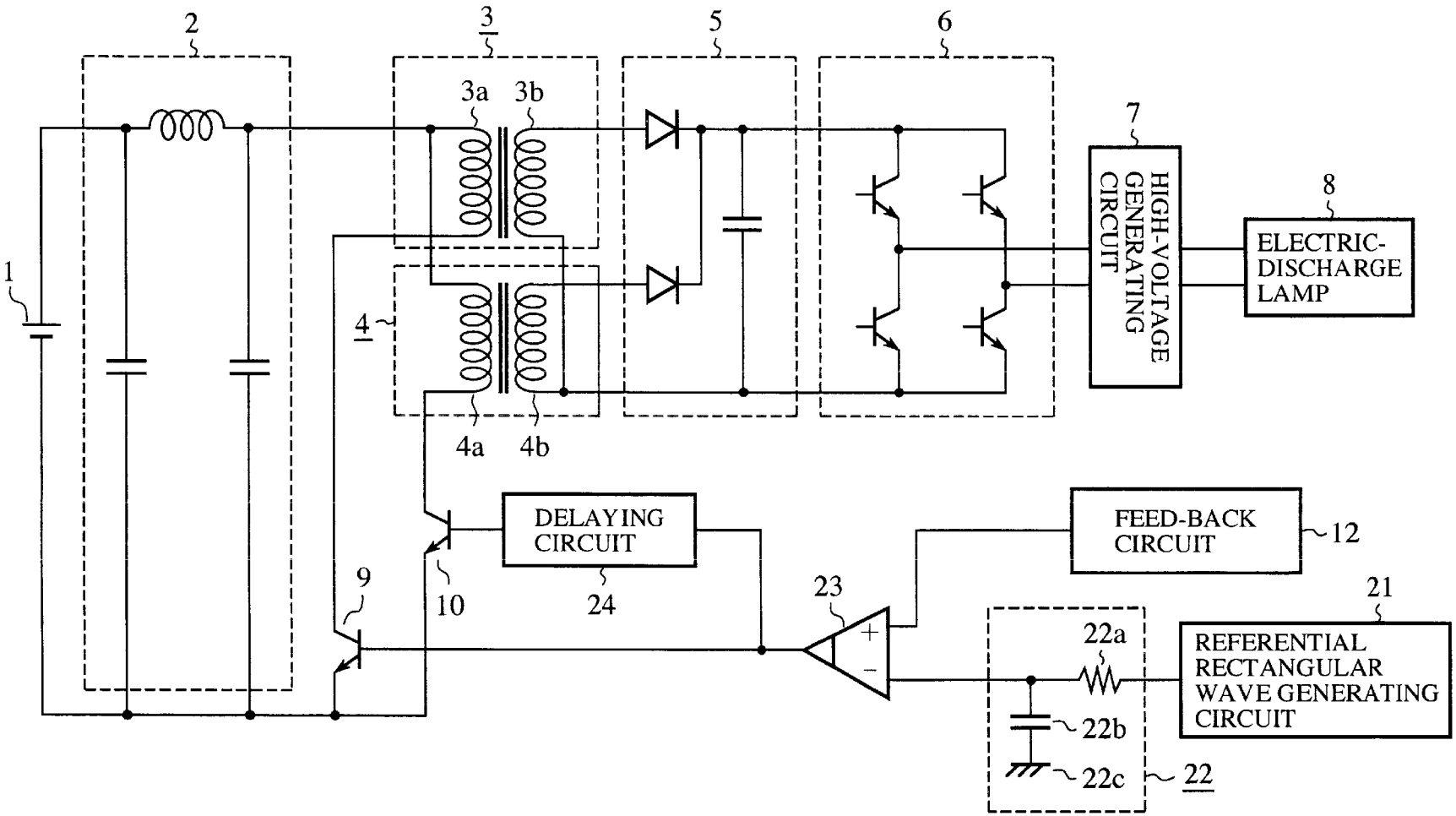
FIG. 2 is a circuit view showing an electric-discharge lamp lighting apparatus according to a first embodiment of the present invention.

FIG. 2 is a circuit view showing an electric-discharge lamp lighting apparatus according to a first embodiment of the present invention.

In FIG. 2, 1 indicates a direct-current power source (12 V). 2 indicates an LC filter. 3*a* indicates a primary winding connected with the direct-current power source 1. 4*a* indicates a primary winding connected with the direct-current power source 1. 3*b* indicates a secondary winding for rising a level of voltage generated in the primary winding 3*a*. 4*b* indicates a secondary winding for rising a level of voltage generated in the primary winding 4*a*. 3 indicates a transformer (or a first transformer). 4 indicates a transformer (or a second transformer).

5 indicates a smoothing circuit for smoothing a level of voltage generated in the secondary winding 3*b* and a level of voltage generated in the secondary winding 4*b*. 6 indicates an H-bridge circuit (or an electric-discharge voltage applying circuit) for inverting a polarity of a current supplied to an electric-discharge lamp 8. 7 indicates a high-voltage generating circuit for generating a high voltage (about 20 kV) required to light the electric-discharge lamp 8. 8 indicates the electric-discharge lamp (HID) boarded on a vehicle. For example, a halogen lamp generally used as an electric-discharge lamp has a luminance ranging from 1000 to 1500 lm. In contrast, the electric-discharge lamp 8 has a luminance of 3200 lm, so that the electric-discharge lamp 8 is a very bright lamp.

9 indicates a transistor (or a first switching circuit) for performing an on-off control to apply a voltage or no voltage to the primary winding 3*a*. 10 indicates a transistor (or a second switching circuit) for performing an on-off control to apply a voltage or no voltage to the primary winding 4*a*. 12 indicates a feed-back circuit for generating a feed-back voltage.

21 indicates a referential rectangular wave generating circuit for generating a referential rectangular wave. 22 indicates an integrating circuit having an integrating resistor 22*a*, an integrating condenser 22*b* and a ground 22*c*. In the integrating circuit 22, the voltage level of the referential rectangular wave is integrated to produce a chopping wave. 23 indicates a comparing circuit for comparing a voltage level of the chopping wave produced in the integrating circuit 22 and a level of the feed-back voltage generated by the feed-back circuit 12 and outputting a control signal to the transistor 9. 24 indicates a delaying circuit for delaying the control signal produced in the comparing circuit 23 by a delaying time corresponding to 180 degrees in a phase of the control signal and outputting the delayed control signal to the transistor 10.

Next, an operation will be described below.

A power source voltage of the direct-current power source 1 is applied to the primary windings 3*a* and 4*a* of the transformers 3 and 4. When an on-off control (or a chopping control) is performed by the transistors 9 and 10 for the power source voltage, a risen-up voltage higher than the power source voltage is generated in the secondary windings 3*b* and 4*b* of the transformers 3 and 4. A current of the risen-up voltage higher than the power source voltage generated in the secondary windings 3*b* and 4*b* of the transformers 3 and 4 is smoothed in the smoothing circuit 5, and the risen-up voltage is applied to the electric-discharge lamp 8 while inverting the polarity of the current of the risen-up voltage in the H-bridge circuit 6. Also, when the electric-discharge lamp 8 is lighted, a high voltage of about 20 kV is required. Therefore, the risen-up voltage is applied to the electric-discharge lamp 8 through the high-voltage generating circuit 7.

Here, control signals for the transistors 9 and 10 are produced as follows.

A referential rectangular wave is generated in the referential rectangular wave generating circuit 21. In the integrating circuit 22, the voltage level of the referential rectangular wave is integrated to produce a chopping wave. In the comparing circuit 23, a voltage level of the chopping wave produced in the integrating circuit 22 is compared with a level of the feed-back voltage generated by the feed-back circuit 12, and a control signal is output to the transistor 9. Also, in the delaying circuit 24, the control signal produced in the comparing circuit 23 is delayed by a delaying time corresponding to 180 degrees in a phase of the control signal to produce a delayed control signal without changing a duty ratio of the delayed control signal in the on-off control of the transistor 10, and the delayed control signal is output to the transistor 10.

Therefore, the control signal and the delayed control signal have phases shifted from each other by 180 degrees and are supplied to the transistors 9 and 10.

As is described above, in the first embodiment, an electric-discharge lamp lighting apparatus operable at high speed without using a circuit for inverting the chopping wave produced in the integrating circuit 22 can be obtained at low cost.

Embodiment 2

Figure 3:
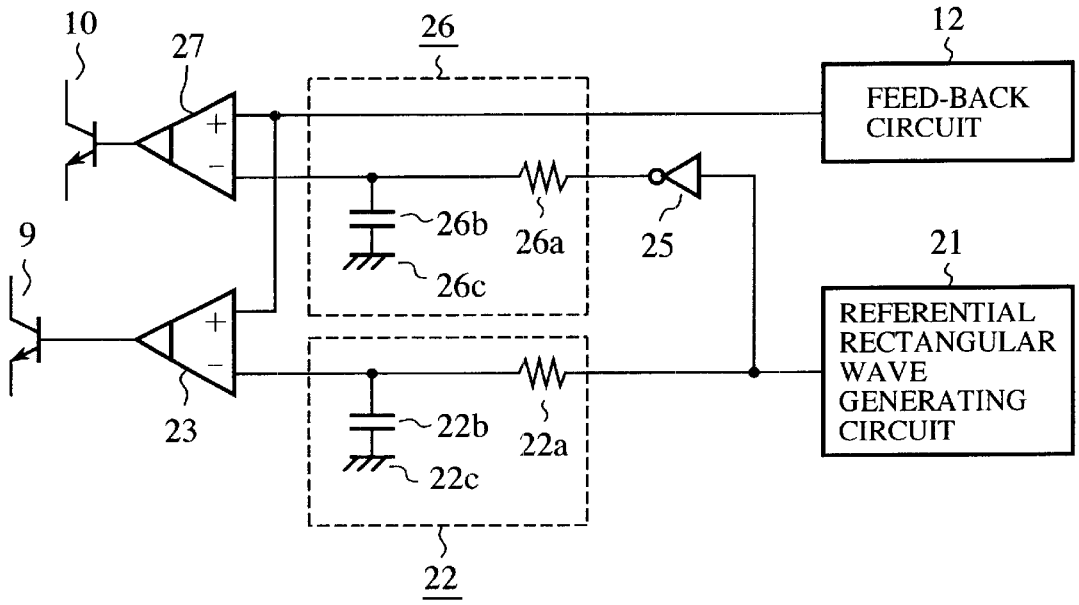
FIG. 3 is a circuit view showing an electric-discharge lamp lighting apparatus according to a second embodiment of the present invention.

FIG. 3 is a circuit view showing an electric-discharge lamp lighting apparatus according to a second embodiment of the present invention.

In FIG. 3, 25 indicates an inverter (or an inverting circuit) for inverting the referential rectangular wave generated in the referential rectangular wave generating circuit 21. 22 indicates the integrating circuit (or a first integrating circuit) having the integrating resistor 22*a*, the integrating condenser 22*b* and the ground 22*c*. In the integrating circuit 22, the voltage level of the referential rectangular wave is integrated to produce a chopping wave. 26 indicates an integrating circuit (or a second integrating circuit) having an integrating resistor 26*a*, an integrating condenser 26*b* and a ground 26*c*. In the integrating circuit 26, the voltage level of the referential rectangular wave inverted in the inverter 25 is integrated to produce another chopping wave. 23 indicates the comparing circuit (or a first comparing circuit) for comparing a voltage level of the chopping wave produced in the integrating circuit 22 and a level of the feed-back voltage generated by the feed-back circuit 12 and outputting a control signal to the transistor 9. 27 indicates another comparing circuit (or a second comparing circuit) for comparing a voltage level of the chopping wave produced in the integrating circuit 26 and a level of the feed-back voltage generated by the feed-back circuit 12 and outputting another control signal to the transistor 10. The other constituent elements of the electric-discharge lamp lighting apparatus are the same as those shown in FIG. 2, and additional description of those constituent elements is omitted.

Next, an operation will be described below.

In the first embodiment, the delayed control signal delayed by 180 degrees in phase is produced by using the delaying circuit 24. However, to delay the control signal without changing the duty ratio of the delayed control signal in the on-off control, many elements of the delaying circuit 24 are required, and it is required to limit an allowable error of each of resistors and condensers composing the delaying circuit 24 in the manufacturing.

Therefore, control signals for the transistors 9 and 10 in the second embodiments are produced as follows.

The referential rectangular wave generated in the referential rectangular wave generating circuit 21 is inverted in the inverter 25. The voltage level of the referential rectangular wave generated in the referential rectangular wave generating circuit 21 is integrated in the integrating circuit 22 to produce a chopping wave, and the voltage level of the referential rectangular wave inverted in the inverter 25 is integrated in the integrating circuit 26 to produce another chopping wave. In the comparing circuit 23, a voltage level of the chopping wave produced in the integrating circuit 22 is compared with a level of the feed-back voltage generated by the feed-back circuit 12, and a control signal is output to the transistor 9. Also, in the comparing circuit 27, a voltage level of the chopping wave produced in the integrating circuit 26 is compared with a level of the feed-back voltage generated by the feed-back circuit 12, and another control signal is output to the transistor 10.

Therefore, the control signals have phases shifted from each other by 180 degrees and are supplied to the transistors 9 and 10.

As is described above, in the second embodiment, the referential rectangular wave is inverted in the inverter 25, and the chopping waves having an inverted relation to each other are produced in the integrating circuits 22 and 26. Therefore, an electric-discharge lamp lighting apparatus operable at high speed can be obtained at low cost without using a circuit for inverting any chopping wave.

Also, there is no configuration for delaying the control signal. Therefore, the delaying circuit 24 is not used, and it is not required to consider a function of each resistor or condenser composing the delaying circuit 24 not accurately set to a designed function.

Embodiment 3

Figure 4:
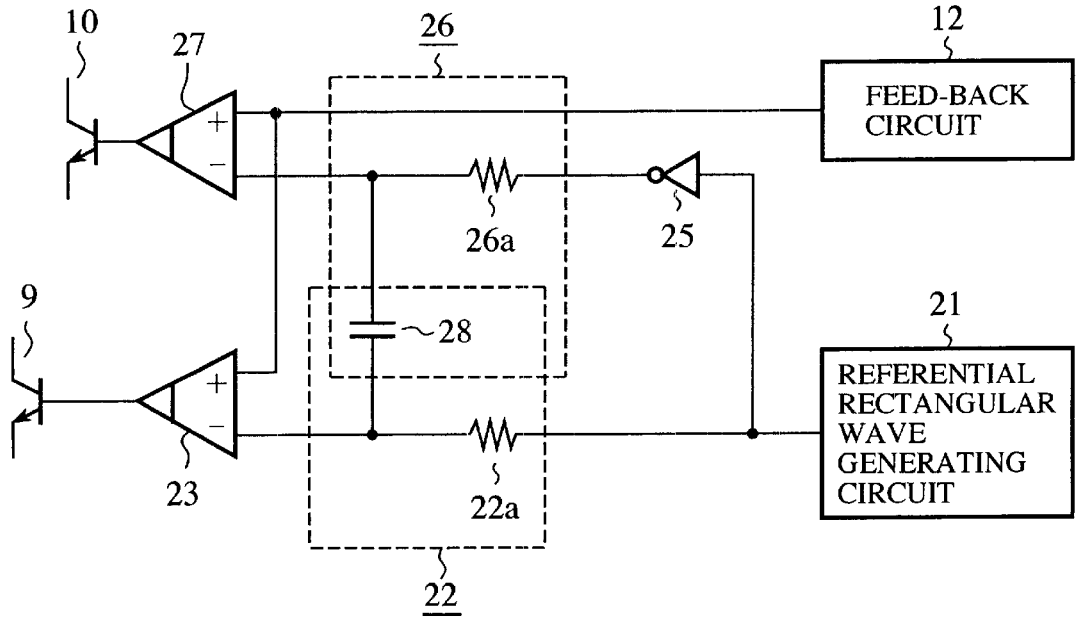
FIG. 4 is a circuit view showing an electric-discharge lamp lighting apparatus according to a third embodiment of the present invention.

FIG. 4 is a circuit view showing an electric-discharge lamp lighting apparatus according to a third embodiment of the present invention. In FIG. 4, 22*a* indicates the integrating resistor (or a first resisting element). 26*a* indicates the integrating resistor (or a second resisting element). 28 indicates an integrating condenser (or a common condenser) in which both ends are connected with output terminals of the integrating resistor 22*a* and the integrating resistor 26*a* respectively in parallel connection. A first integrating circuit comprises the integrating resistor 22*a*, the integrating condenser 28 and the ground 22*c*. A second integrating circuit comprises the integrating resistor 26*a*, the integrating condenser 28 and the ground 26*c*. The other constituent elements of the electric-discharge lamp lighting apparatus are the same as those shown in FIG. 3, and additional description of those constituent elements is omitted.

Next, an operation will be described below.

In the second embodiment, the integrating circuits 22 and 26 independent from each other are used. However, there is a possibility that a level inclination or a wave height value of the chopping wave produced in the integrating circuit 22 or 26 is not correctly set to a designed value because of an error of each constituent element of the integrating circuit 22 or 26 in the manufacturing. In this case, the chopping waves perfectly symmetric to each other cannot be obtained.

Therefore, in the integrating circuit 22 or 26 according to the third embodiment, the integrating condenser 28 used for the first and second integrating circuits in common is arranged in place of the integrating condensers 22*b* and 26*b* arranged independently from each other. In each end of the integrating condenser 28, the referential rectangular wave or the converted referential rectangular wave is integrated. Therefore, the referential rectangular wave and the converted referential rectangular wave are respectively transformed into chopping waves symmetric to each other on both ends of the integrating condenser 28.

As is described above, in the third embodiment, because the integrating condenser 28 used for the first and second integrating circuits in common is arranged, the total configuration of the integrating circuits 22 and 26 can be simplified. Also, the asymmetry between the chopping waves produced in the integrating condensers 22*b* and 26*b* not accurately set to designed functions can be suppressed. Here, the asymmetry between the chopping waves due to the integrating resistors 22*a* and 26*a* not accurately set to designed functions remains. However, the influence of the integrating resistors 22*a* and 26*a* not accurately set to designed functions on the asymmetry between the chopping waves is considerably low as compared with the influence of the integrating condensers 22*b* and 26*b* not accurately set to designed functions.

Embodiment 4

Figure 5:
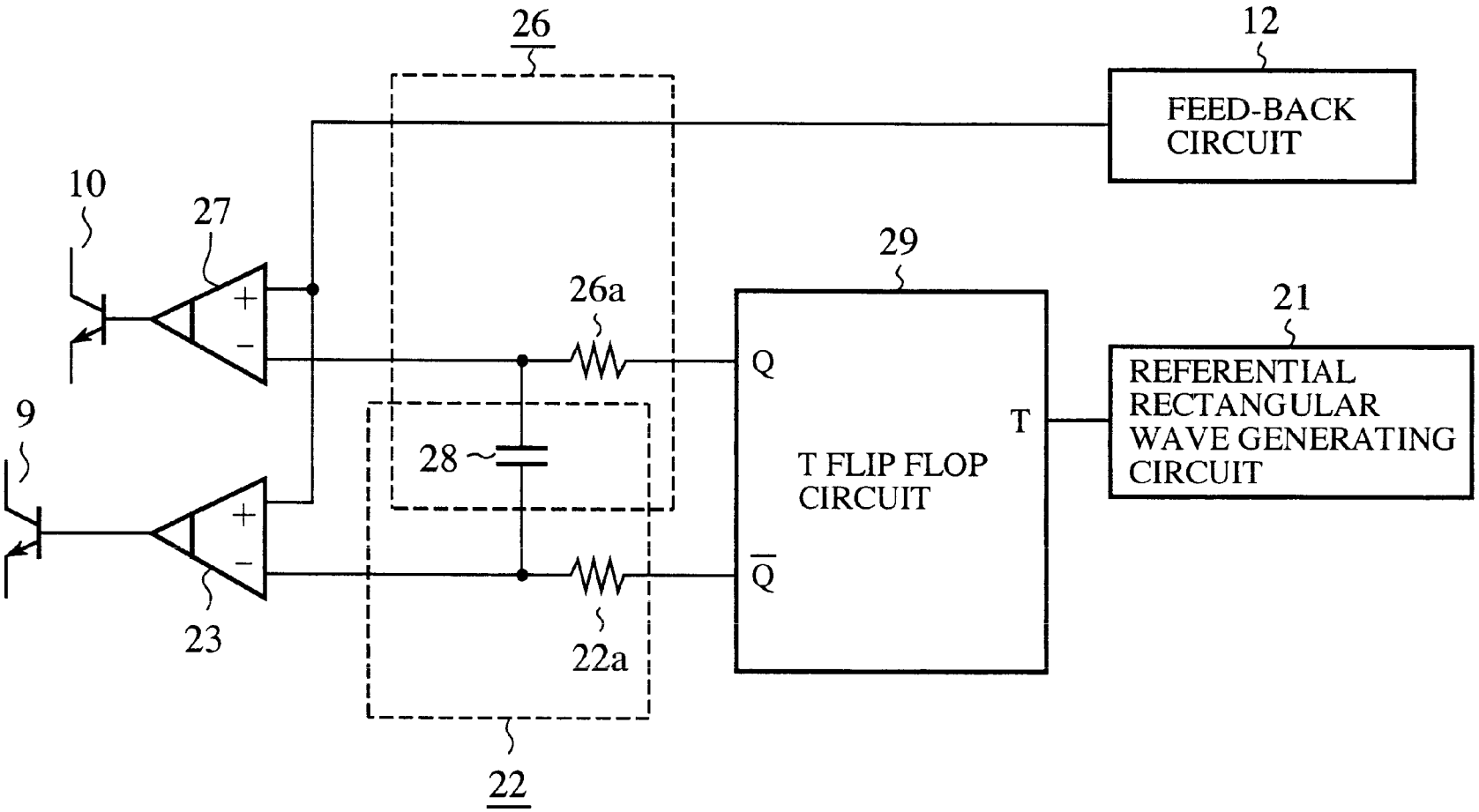
FIG. 5 is a circuit view showing an electric-discharge lamp lighting apparatus according to a fourth embodiment of the present invention.

FIG. 5 is a circuit view showing an electric-discharge lamp lighting apparatus according to a fourth embodiment of the present invention.

In FIG. 5, 29 indicates a T flip flop circuit (or a flip flop) for receiving the referential rectangular wave generated in the referential rectangular wave generating circuit 21, dividing a frequency of the referential rectangular wave by two and producing a non-inverted rectangular wave and an inverted rectangular wave. The other constituent elements of the electric-discharge lamp lighting apparatus are the same as those shown in FIG. 4, and additional description of those constituent elements is omitted.

Next, an operation will be described below.

In the first to third embodiments, unless the duty ratio of the referential rectangular wave generated in the referential rectangular wave generating circuit 21 is equal to 50%, a DC offset between the chopping waves produced in the integrating circuits 22 and 26 occurs, and an average voltage of each chopping wave undesirably differs from an average voltage of the referential rectangular wave.

Therefore, control signals for the transistors 9 and 10 in the fourth embodiments are produced as follows.

In the T flip flop circuit 29, the referential rectangular wave generated in the referential rectangular wave generating circuit 21 is received, a frequency of the referential rectangular wave is divided by two, and a non-inverted rectangular wave and an inverted rectangular wave are produced. Here, in the T flip flop circuit 29, the frequency of the referential rectangular wave is divided by two, and a non-inverted rectangular wave and an inverted rectangular wave are produced. Therefore, though the frequency of the referential rectangular wave is halved, the duty ratio of each rectangular wave produced in the T flip flop circuit 29 can be set to 50% even though the duty ratio of the referential rectangular wave is not equal to 50%.

Thereafter, the voltage level of the non-inverted rectangular wave is integrated in the integrating circuit 26 to produce a chopping wave, and the voltage level of the inverted rectangular wave is integrated in the integrating circuit 22 to produce another chopping wave. In the comparing circuit 23, a voltage level of the chopping wave produced in the integrating circuit 22 is compared with a level of the feed-back voltage, and a control signal is output to the transistor 9. Also, in the comparing circuit 27, a voltage level of the chopping wave produced in the integrating circuit 26 is compared with a level of the feed-back voltage, and another control signal is output to the transistor 10.

Therefore, the control signals have phases shifted from each other by 180 degrees and are supplied to the transistors 9 and 10.

As is described above, in the fourth embodiment, the referential rectangular wave is inverted in the T flip flop circuit 29, and the chopping waves having an inverted relation to each other are produced in the integrating circuits 22 and 26. Accordingly, an electric-discharge lamp lighting apparatus operable at high speed can be obtained at low cost without using a circuit for inverting any chopping wave.

Also, because the frequency of the referential rectangular wave is divided by two in the T flip flop circuit 29, the duty ratio of each rectangular wave produced in the T flip flop circuit 29 can be set to 50%. Therefore, no DC offset between the produced chopping waves occurs. Accordingly, the average voltage of each chopping wave can agree with the average voltage of the referential rectangular wave, and the control signals having levels set with high accuracy can be output.

Embodiment 5

Figure 6:
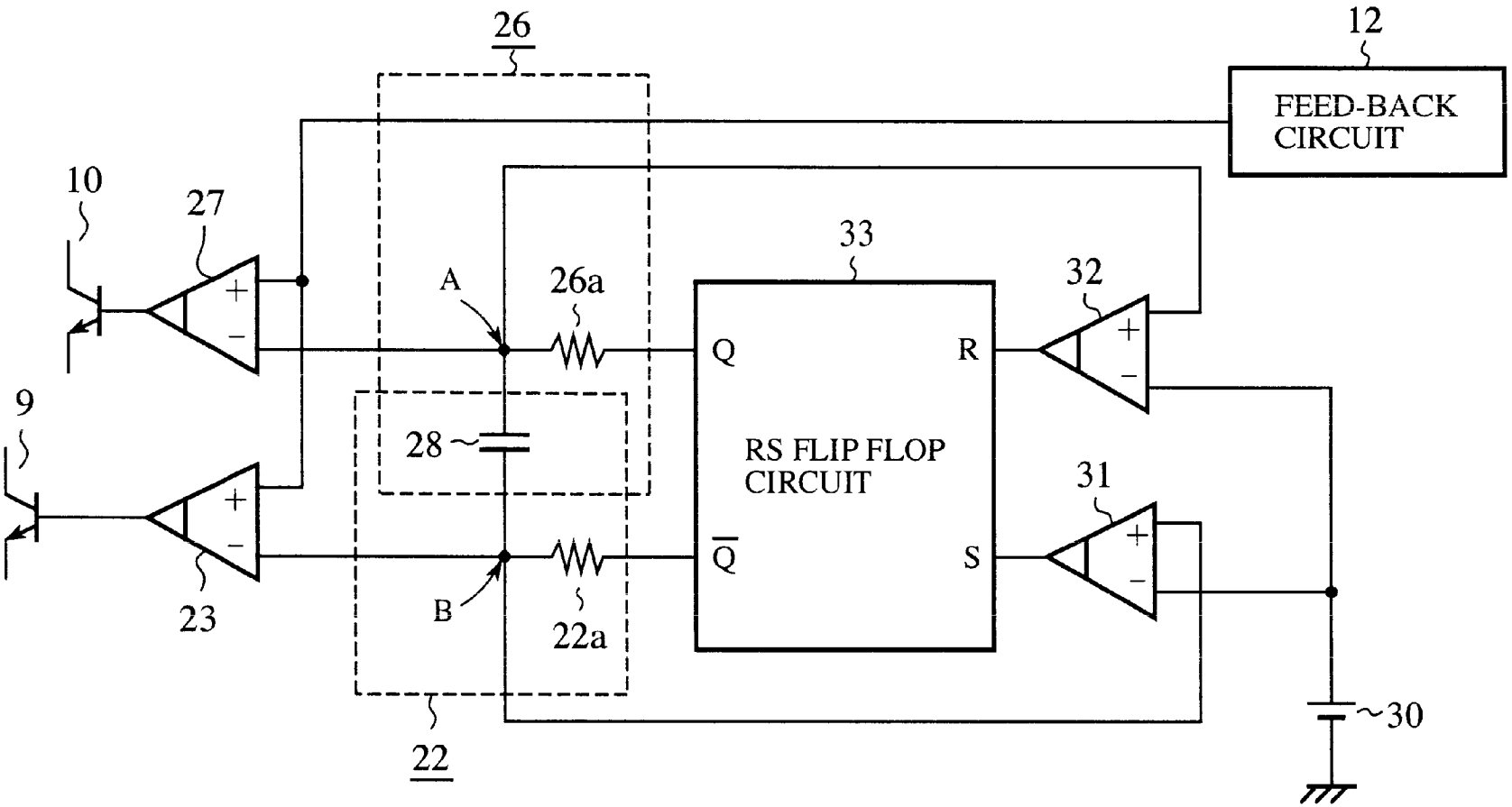
FIG. 6 is a circuit view showing an electric-discharge lamp lighting apparatus according to a fifth embodiment of the present invention.

FIG. 6 is a circuit view showing an electric-discharge lamp lighting apparatus according to a fifth embodiment of the present invention.

In FIG. 6, 30 indicates a comparing power source for generating a comparing voltage. 31 indicates a comparing circuit (or a third comparing circuit) for comparing a voltage level of the comparing voltage and the voltage level of the chopping wave produced in the integrating circuit 22. 32 indicates a comparing circuit (or a fourth comparing circuit) for comparing a voltage level of the comparing voltage and the voltage level of the chopping wave produced in the integrating circuit 26. 33 indicates a RS flip flop for receiving output signals of the comparing circuits 31 and 32 and producing a non-inverted rectangular wave and an inverted rectangular wave. The other constituent elements of the electric-discharge lamp lighting apparatus are the same as those shown in FIG. 5, and additional description of those constituent elements is omitted.

Next, an operation will be described below.

In the fourth embodiment, frequencies of a plurality of referential rectangular waves input to a plurality of T flip flop circuits 29 of a plurality of electric-discharge lamp lighting apparatuses have various values. That is, the frequency of the referential rectangular wave input to the T flip flop circuit 29 is not correctly set to a designed value in the manufacturing. Also, a function of each constituent element of the integrating circuits 22 and 26 is not correctly set to a designed function in the manufacturing. Therefore, the wave height value (or a P—P voltage) of each produced chopping wave is not correctly set to a designed value.

Therefore, control signals for the transistors 9 and 10 in the fifth embodiments are produced as follows.

In the comparing power source 30, a comparing voltage is generated. In the comparing circuit 31, a voltage level of the comparing voltage is compared with the voltage level of the chopping wave produced in the integrating circuit 22. In the comparing circuit 32, a voltage level of the comparing voltage is compared with the voltage level of the chopping wave produced in the integrating circuit 26.

In the RS flip flop circuit 33, output signals of the comparing circuits 31 and 32 are received, and a non-inverted rectangular wave and an inverted rectangular wave are produced.

Thereafter, the voltage level of the non-inverted rectangular wave is integrated in the integrating circuit 26 to produce a chopping wave, and the voltage level of the inverted rectangular wave is integrated in the integrating circuit 22 to produce another chopping wave. Thereafter, the chopping wave produced in the integrating circuit 22 is fed back to the comparing circuit 31, and the chopping wave produced in the integrating circuit 26 is fed back to the comparing circuit 32. Therefore, waves output from the RS flip flop circuit 33 are respectively oscillated at the inversion timing of the RS flip flop circuit 33. That is, a self-oscillation type is adopted, and waves output from the RS flip flop circuit 33 are respectively self-oscillated as the non-inverted rectangular wave and the inverted rectangular wave.

In the comparing circuit 23, a voltage level of the chopping wave produced in the integrating circuit 22 is compared with a level of the feed-back voltage, and a control signal is output to the transistor 9. Also, in the comparing circuit 27, a voltage level of the chopping wave produced in the integrating circuit 26 is compared with a level of the feed-back voltage, and another control signal is output to the transistor 10.

Therefore, the control signals have phases shifted from each other by 180 degrees and are supplied to the transistors 9 and 10.

As is described above, in the fifth embodiment, the non-inverted rectangular wave and the inverted rectangular wave are produced in the RS flip flop circuit 33, and the chopping waves having an inverted relation to each other are produced in the integrating circuits 22 and 26. Accordingly, an electric-discharge lamp lighting apparatus operable at high speed can be obtained at low cost without using a circuit for inverting any chopping wave.

Also, a result of a comparison between the chopping wave produced in the integrating circuit 22 and the comparing voltage is obtained, a result of a comparison between the chopping wave produced in the integrating circuit 26 and the comparing voltage is obtained, and a self-oscillation type is adopted by feeding back both the comparison results to the RS flip flop circuit 33 and by self-oscillating the non-inverted rectangular wave and the inverted rectangular wave output from the RS flip flop circuit 33. Therefore, no influence of the frequency of the referential rectangular wave shifted from a designed frequency is exerted on the produced chopping waves, no influence of a function of each constituent element of the integrating circuits 22 and 26 shifted from a designed function is exerted on the produced chopping waves, and no DC offset between the produced chopping waves occurs. Accordingly, the chopping waves symmetric to each other and having the same wave height value as each other can be obtained, and the control signals having levels set with high accuracy can be output.

Embodiment 6

Figure 7:
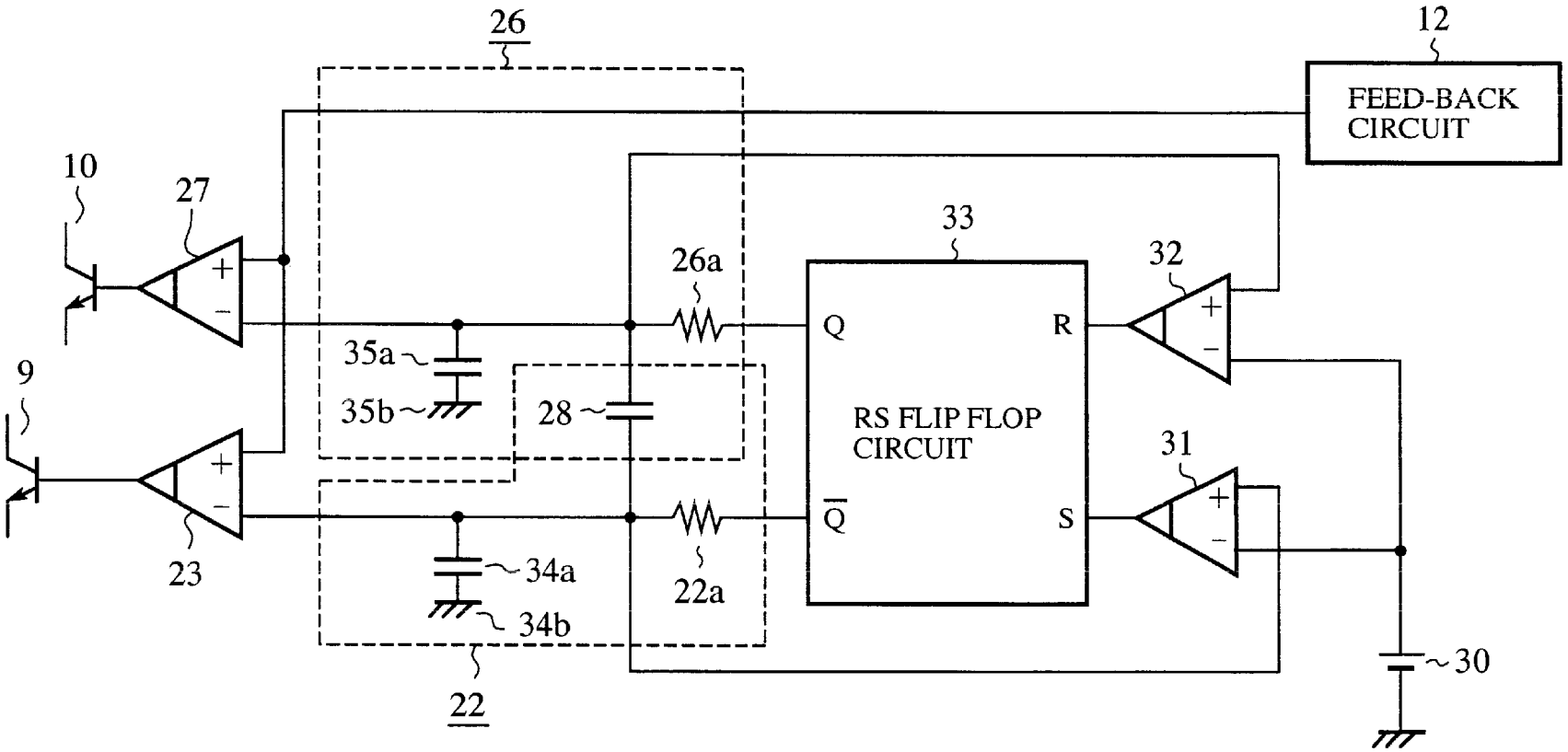
FIG. 7 is a circuit view showing an electric-discharge lamp lighting apparatus according to a sixth embodiment of the present invention.

FIG. 7 is a circuit view showing an electric-discharge lamp lighting apparatus according to a sixth embodiment of the present invention.

In FIG. 7, 34*a* indicates a condenser (or a first condenser) in which one end is connected with the output terminal of the integrating resistor 22*a* and the other end is connected with the ground 34*b*. 35*a* indicates a condenser (or a second condenser) in which one end is connected with the output terminal of the integrating resistor 26*a* and the other end is connected with the ground 35*b*. The other constituent elements of the electric-discharge lamp lighting apparatus are the same as those shown in FIG. 6, and additional description of those constituent elements is omitted.

Next, an operation will be described below.

In the fifth embodiment, the simultaneous level change in the pair of output waves of the RS flip flop circuit 33 is not necessarily performed. Also, in a circuit configuration including an inverter, a transfer lag necessarily occurs in the inverter.

Figure 8:
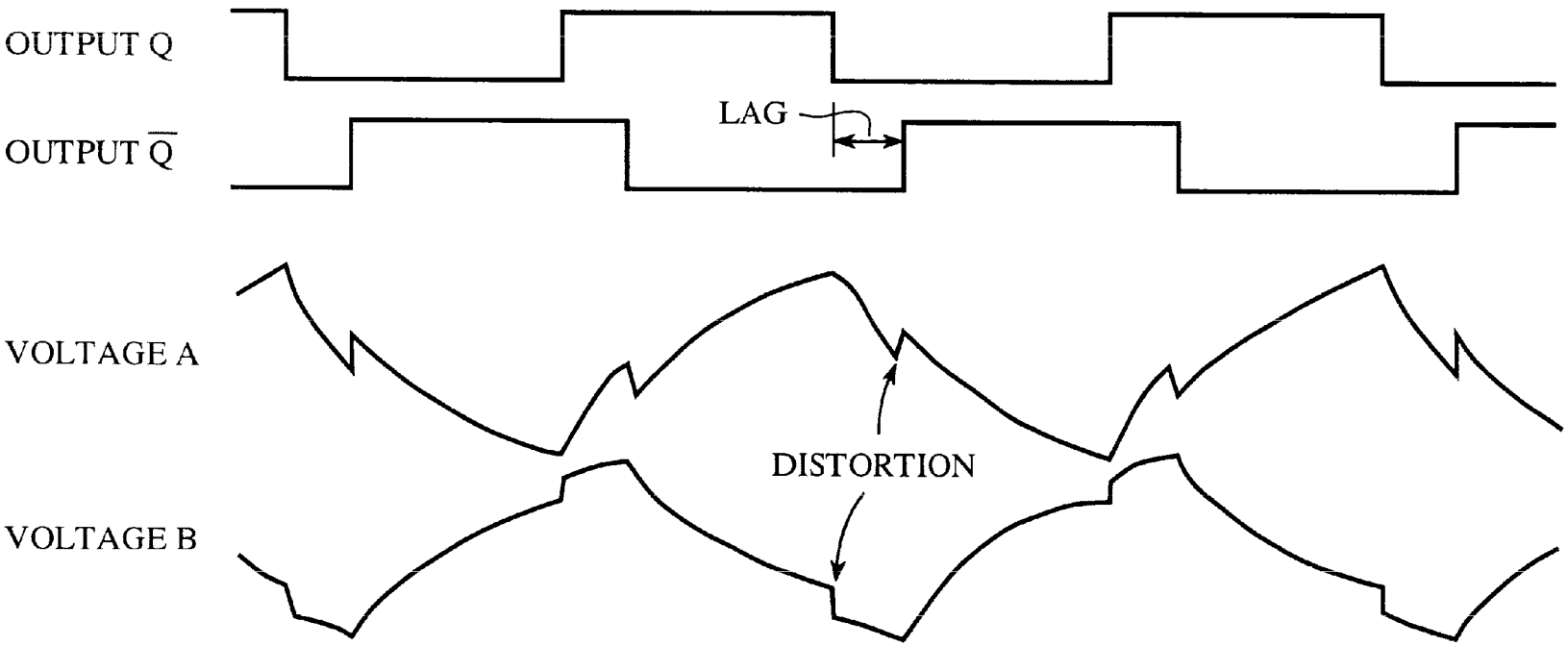
FIG. 8 is a wave shape view showing a wave shape of a main portion of the electric-discharge lamp lighting apparatus according to the fifth embodiment of the present invention.

FIG. 8 is a wave shape view showing a wave shape of a main portion of the electric-discharge lamp lighting apparatus according to the fifth embodiment of the present invention.

As shown in FIG. 8, a lag occurs in the pair of output waves of the RS flip flop circuit 33, and distortion occurs in the chopping waves produced in the integrating circuits 22 and 26. Therefore, because one of the pair of output waves of the RS flip flop circuit 33 lags behind the other one, step-shaped distortion occurs in portions of the chopping waves produced in the integrating circuits 22 and 26.

Therefore, in the sixth embodiment, the condensers 34*a* and 35*a* are arranged in the integrating circuits 22 and 26 respectively to reduce the distortion of the chopping waves, and the distortion of the chopping waves is reduced by the function of the condensers 34*a* and 35*a*.

The influence of functions of the condensers 34*a* and 35*a* shifted from designed functions is equal to half of the influence of functions of the integrating condensers 22*b* and 26*b* (refer to FIG. 3) shifted from designed functions. Therefore, the influence of functions of the condensers 34*a* and 35*a* shifted from designed functions is low.

As is described above, in the sixth embodiment, the distortion of the chopping waves occurring due to a phase difference (or a phase difference from 180 degrees) between the non-inverted rectangular wave and the inverted rectangular wave produced in the RS flip flop circuit 33 can be reduced by the function of the condensers 34*a* and 35*a*.

Embodiment 7

Figure 9:
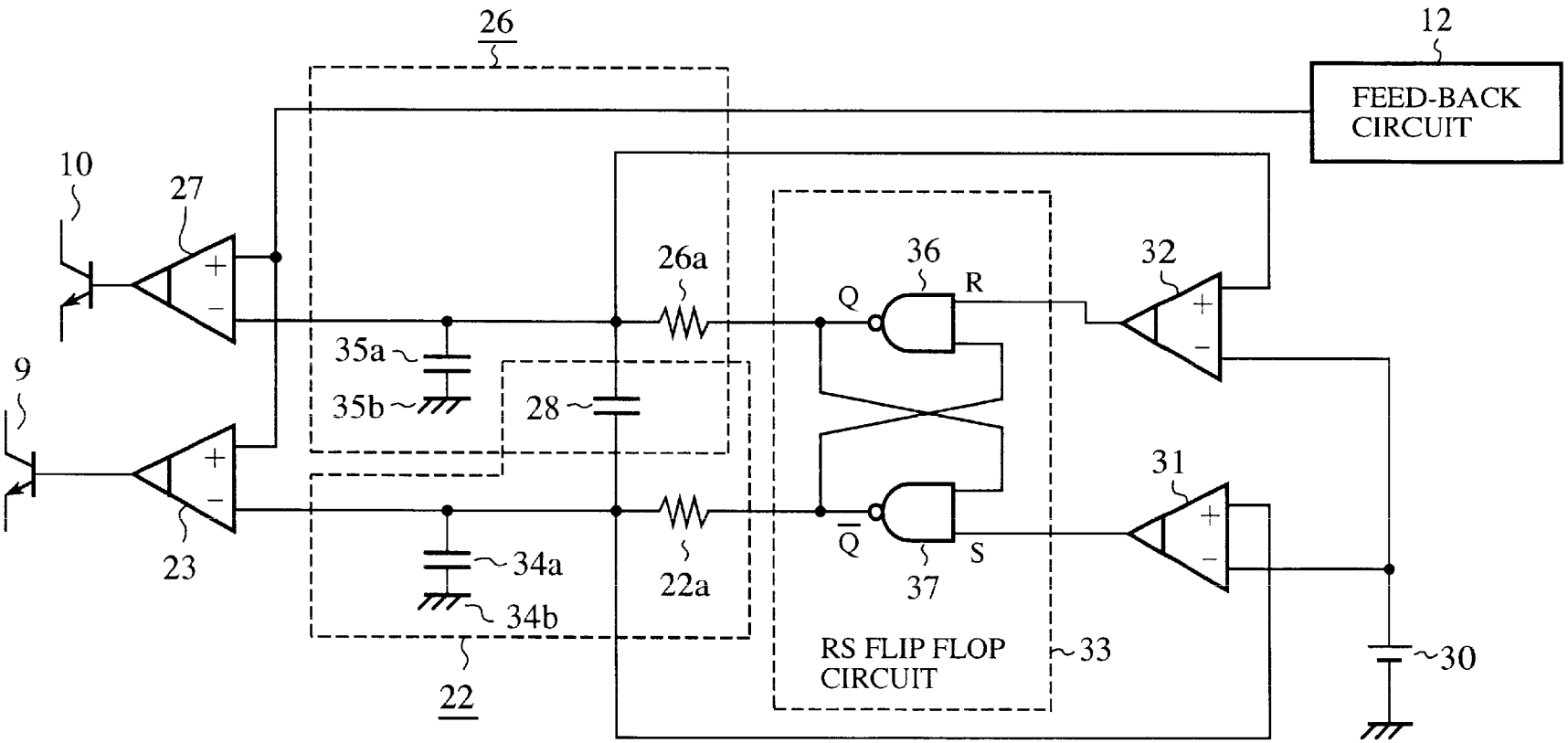
FIG. 9 is a circuit view showing an electric-discharge lamp lighting apparatus according to a seventh embodiment of the present invention.

FIG. 9 is a circuit view showing an electric-discharge lamp lighting apparatus according to a seventh embodiment of the present invention.

In FIG. 9, 36 and 37 indicate NAND gates composing the RS flip flop circuit 33 respectively.

As is described above, in the seventh embodiment, the RS flip flop circuit 33 can be easily structured by using a logic gate integrated circuit (IC).

Embodiment 8

Figure 10:
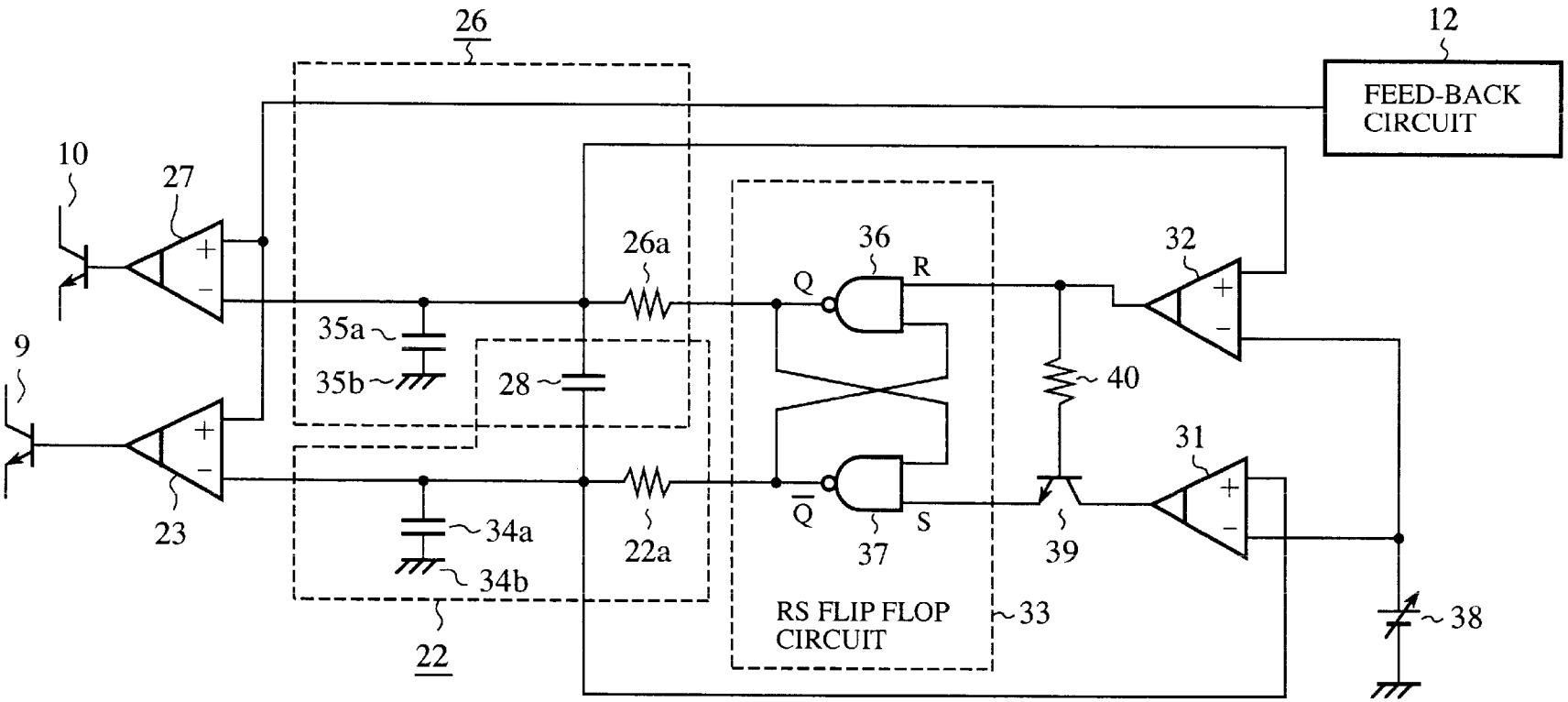
FIG. 10 is a circuit view showing an electric-discharge lamp lighting apparatus according to an eighth embodiment of the present invention.

FIG. 10 is a circuit view showing an electric-discharge lamp lighting apparatus according to an eighth embodiment of the present invention.

In FIG. 10, 38 indicates a variable power source for generating a comparing voltage arbitrarily adjustable. 39 indicates a transistor (or a third switching circuit) in which one end is connected with the comparing circuit 31 and another end is connected with the RS flip flop circuit 33. The transistor 39 is turned on or turned off according to the output signal of the comparing circuit 32 to perform an on-off control. 40 indicates a resistor. The other constituent elements of the electric-discharge lamp lighting apparatus are the same as those shown in FIG. 9, and additional description of those constituent elements is omitted.

Next, an operation will be described below.

In the fifth to seventh embodiments, in cases where input signals of the RS flip flop circuit 33 are set to the same level at an operation start time in the same manner as output signals of the RS flip flop circuit 33 set to the same level, there is a possibility that output levels of the RS flip flop circuit 33 are always fixed. As a result, there is a possibility that either a non-inverted chopping wave or an inverted chopping wave is not produced in the RS flip flop circuit 33.

Figure 11:
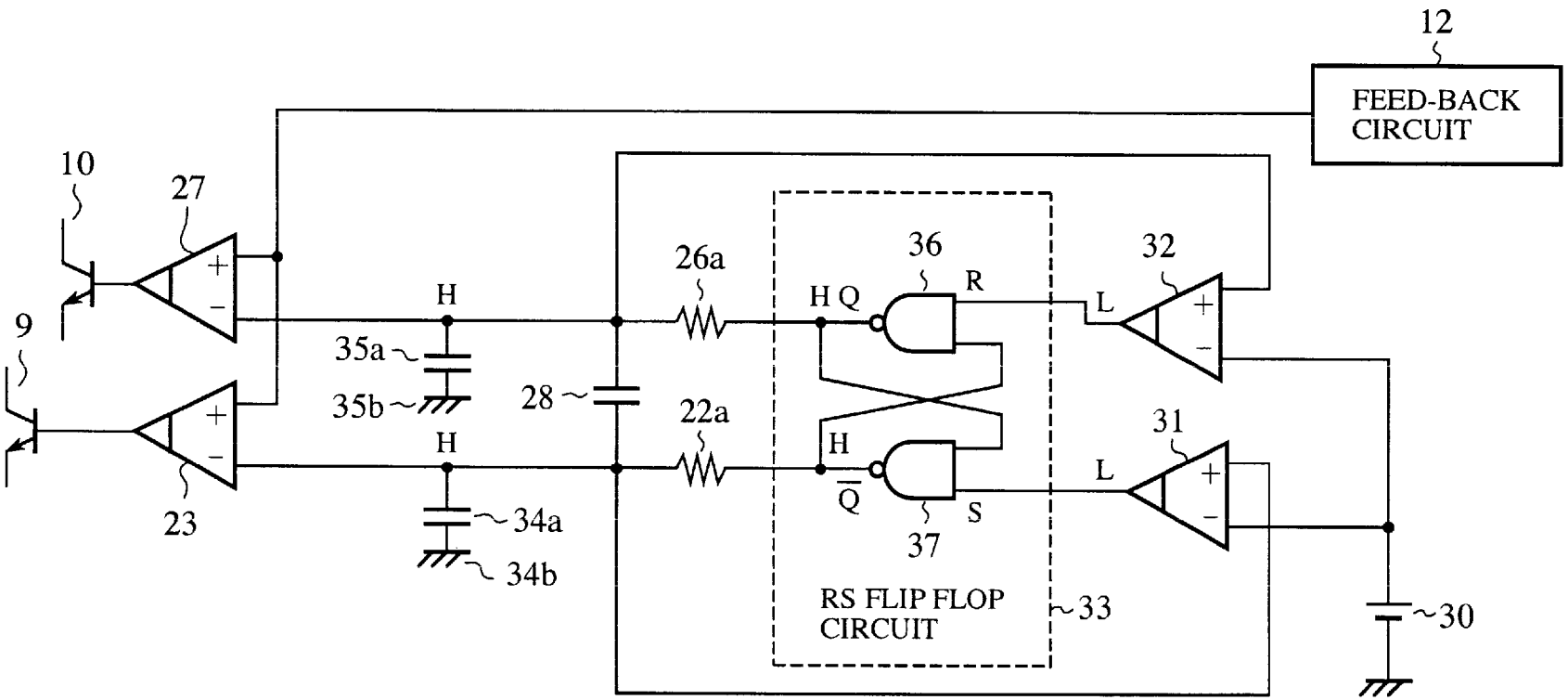
FIG. 11 is an explanatory view showing a signal level of a main portion of the electric-discharge lamp lighting apparatus according to the seventh embodiment of the present invention.

FIG. 11 is an explanatory view showing a signal level of a main portion of the electric-discharge lamp lighting apparatus according to the seventh embodiment of the present invention. As shown in FIG. 11, input signals of the RS flip flop circuit 33 at an operation start time are set to the low (L) level together, so that output signals of the RS flip flop circuit 33 are fixed to the high (H) level together. As a result, either a non-inverted chopping wave or an inverted chopping wave is not produced in the RS flip flop circuit 33.

Therefore, in the eighth embodiment, the transistor 39 is connected with the comparing circuit 31 and the RS flip flop circuit 33 to be arranged between the comparing circuit 31 and the RS flip flop circuit 33, and the transistor 39 is operated according to an output signal of the comparing circuit 32 sent through the resistor 40. In this case, even though output signals of the comparing circuits 31 and 32 are set to the L level together, the transistor 39 is turned off so as to set one input signal of the RS flip flop circuit 33 to the H level. Therefore, the normal operation of the RS flip flop circuit 33 and the integrating circuits 22 and 26 can be performed.

Also, the levels of the output signals of the comparing circuits 31 and 32 can be adjusted by arbitrarily adjusting the comparing voltage in the variable power source 38, and the cycle of each chopping wave produced in the RS flip flop circuit 33 can be arbitrarily adjusted.

As is described above, in the eighth embodiment, even though the output signals of the comparing circuits 31 and 32 are set to the L level together, the transistor 39 is turned off, and one input signal of the RS flip flop circuit 33 is set to the H level. Therefore, the normal operation of the RS flip flop circuit 33 can be performed.

Also, the levels of the output signals of the comparing circuits 31 and 32 can be adjusted according to the adjustment of the comparing voltage performed in the variable power source 38, and the cycle of each chopping wave produced in the RS flip flop circuit 33 can be arbitrarily adjusted.

INDUSTRIAL APPLICABILITY

As is described above, in the electric-discharge lamp lighting apparatus according to the present invention, the control signals set with high accuracy can be supplied to the transistors 9 and 10 by using the electric-discharge lamp lighting apparatus manufactured in a simple configuration and at low cost. Therefore, the present invention is appropriate for an electric-discharge lamp lighting apparatus which is manufactured at low cost and is operated at high speed.

What is claimed is:

1. An electric-discharge lamp lighting apparatus, comprising:

a first transformer, having both a primary winding connected with a direct-current power source and a secondary winding, for rising up a voltage, which is generated in the primary winding, in the secondary winding;

a second transformer, having both a primary winding connected with the direct-current power source and a secondary winding, for rising up a voltage, which is generated in the primary winding, in the secondary winding;

an electric-discharge voltage applying circuit for applying the voltage generated in the first transformer or the second transformer to an electric-discharge lamp through a high voltage generating circuit;

a first switching circuit for performing an on-off control to pass or intercept a voltage applied to the first transformer;

a second switching circuit for performing an on-off control to pass or intercept a voltage applied to the second transformer;

a referential rectangular wave generating circuit for generating a referential rectangular wave;

an inverting circuit for inverting the referential rectangular wave generated in the referential rectangular wave generating circuit;

a first integrating circuit for integrating a level of the referential rectangular wave generated in the referential rectangular wave generating circuit and producing a chopping wave;

a second integrating circuit for integrating a level of a rectangular wave inverted in the inverting circuit and producing a chopping wave;

a first comparing circuit for comparing a level of the chopping wave produced in the first integrating circuit and a feed-back voltage sent from a feed-back circuit and outputting a control signal to the first switching circuit; and a second comparing circuit for comparing a level of the chopping wave produced in the second integrating circuit and the feed-back voltage sent from the feed-back circuit and outputting a control signal to the second switching circuit.

2. An electric-discharge lamp lighting apparatus, comprising:

a first transformer, having both a primary winding connected with a direct-current power source and a secondary winding, for rising up a voltage, which is generated in the primary winding, in the secondary winding;

a second transformer, having both a primary winding connected with the direct-current power source and a secondary winding, for rising up a voltage, which is generated in the primary winding, in the secondary winding;

an electric-discharge voltage applying circuit for applying the voltage generated in the first transformer or the second transformer to an electric-discharge lamp through a high voltage generating circuit;

a first switching circuit for performing an on-off control to pass or intercept a voltage applied to the first transformer;

a second switching circuit for performing an on-off control to pass or intercept a voltage applied to the second transformer;

a referential rectangular wave generating circuit for generating a referential rectangular wave;

a flip flop circuit for diving a frequency of the referential rectangular wave generated in the referential rectangular wave generating circuit by two and producing a non-inverted rectangular wave and an inverted rectangular wave;

a first integrating circuit for integrating a level of the inverted rectangular wave produced in the flip flop circuit and producing a chopping wave;

a second integrating circuit for integrating a level of the non-inverted rectangular wave produced in the flip flop circuit and producing a chopping wave;

a first comparing circuit for comparing a level of the chopping wave produced in the first integrating circuit and a feed-back voltage sent from a feed-back circuit and outputting a control signal to the first switching circuit; and a second comparing circuit for comparing a level of the chopping wave produced in the second integrating circuit and the feed-back voltage sent from the feed-back circuit and outputting a control signal to the second switching circuit.

3. An electric-discharge lamp lighting apparatus, comprising:

a first transformer, having both a primary winding connected with a direct-current power source and a secondary winding, for rising up a voltage, which is generated in the primary winding, in the secondary winding;

a second transformer, having both a primary winding connected with the direct-current power source and a secondary winding, for rising up a voltage, which is generated in the primary winding, in the secondary winding;

an electric-discharge voltage applying circuit for applying the voltage generated in the first transformer or the second transformer to an electric-discharge lamp through a high voltage generating circuit;

a first switching circuit for performing an on-off control to pass or intercept a voltage applied to the first transformer;

a second switching circuit for performing an on-off control to pass or intercept a voltage applied to the second transformer;

a comparing power source for generating a comparing voltage;

a third comparing circuit for comparing the comparing voltage generated in the comparing power source and a first chopping wave;

a fourth comparing circuit for comparing the comparing voltage generated in the comparing power source and a second chopping wave;

an RS flip flop circuit for receiving both an output signal of the third comparing circuit and an output signal of the fourth comparing circuit and producing a non-inverted rectangular wave and an inverted rectangular wave;

a first integrating circuit for integrating a level of the inverted rectangular wave produced in the RS flip flop circuit, producing the first chopping wave and supplying the first chopping wave to the third comparing circuit;

a second integrating circuit for integrating a level of the non-inverted rectangular wave produced in the RS flip flop circuit, producing the second chopping wave and supplying the second chopping wave to the fourth comparing circuit;

a first comparing circuit for comparing a level of the first chopping wave produced in the first integrating circuit and a feed-back voltage sent from a feed-back circuit and outputting a control signal to the first switching circuit; and a second comparing circuit for comparing a level of the second chopping wave produced in the second integrating circuit and the feed-back voltage sent from the feed-back circuit and outputting a control signal to the second switching circuit.

4. An electric-discharge lamp lighting apparatus according to claim 3, wherein the first integrating circuit comprises a first resisting element and a common condenser, the second integrating circuit comprises a second resisting element and the common condenser, and the common condenser is connected with both an output terminal of the first resisting element and an output terminal of the second resisting element in parallel connection.

5. An electric-discharge lamp lighting apparatus according to claim 4, wherein the first integrating circuit further comprises a first condenser in which one end is connected with the output terminal of the first resisting element and the other end is grounded, and the second integrating circuit further comprises a second condenser in which one end is connected with the output terminal of the second resisting element and the other end is grounded.

6. An electric-discharge lamp lighting apparatus according to claim 3, further comprising:

a switching circuit, connected with the third comparing circuit and the RS flip flop circuit, for performing an on-off control according to an output signal of the fourth comparing circuit.

7. An electric-discharge lamp lighting apparatus according to claim 3, wherein the comparing power source is formed of a variable power source, and the comparing voltage generated in the variable power source is arbitrarily adjustable.

8. An electric-discharge lamp lighting apparatus according to claim 3, wherein the RS flip flop circuit is formed of a logic gate integrated circuit.

* * * * *